US008500151B2

(12) United States Patent
Metchik

(10) Patent No.: US 8,500,151 B2
(45) Date of Patent: Aug. 6, 2013

(54) FOOT SUPPORT DEVICE

(75) Inventor: Asher Metchik, Oceano, CA (US)

(73) Assignee: Strap Pad, LLC, Newport Beach, CA (US)

( * ) Notice: Subject to any disclaimer, the term of this patent is extended or adjusted under 35 U.S.C. 154(b) by 679 days.

(21) Appl. No.: 12/581,041

(22) Filed: Oct. 16, 2009

(65) Prior Publication Data

US 2010/0283226 A1 Nov. 11, 2010

Related U.S. Application Data

(60) Provisional application No. 61/177,164, filed on May 11, 2009.

(51) Int. Cl.
*A63C 9/00* (2012.01)

(52) U.S. Cl.
USPC ..... 280/623; 280/14.21; 280/809

(58) Field of Classification Search
USPC ..... 280/809, 816, 14.21, 623, 634, 14.22, 280/613
See application file for complete search history.

(56) References Cited

U.S. PATENT DOCUMENTS

| | | | | |
|---|---|---|---|---|
| 4,592,734 | A | 6/1986 | Metiver | |
| 4,775,345 | A | 10/1988 | Gifford | |
| 4,915,400 | A | 4/1990 | Chambers | |
| 5,106,118 | A * | 4/1992 | Frey | 280/636 |
| 5,167,553 | A | 12/1992 | Wilson | |
| 5,544,919 | A | 8/1996 | Tinkler | |
| 6,315,305 | B1 * | 11/2001 | Gien | 280/14.24 |
| 6,422,048 | B1 * | 7/2002 | Fontes et al. | 70/58 |
| 6,971,190 | B2 | 12/2005 | Runyan | |
| 7,059,624 | B2 | 6/2006 | Compton | |
| 7,374,180 | B2 * | 5/2008 | Farmer | 280/14.27 |
| 2002/0130509 | A1 | 9/2002 | Leaf et al. | |
| 2003/0137128 | A1 * | 7/2003 | Raffo | 280/611 |
| 2003/0189332 | A1 | 10/2003 | Kohler | |
| 2004/0032122 | A1 | 2/2004 | Giannulli | |
| 2006/0006634 | A1 * | 1/2006 | Packer | 280/809 |
| 2009/0066044 | A1 | 3/2009 | Wasserman | |
| 2009/0066073 | A1 * | 3/2009 | Kawano et al. | 280/816 |

OTHER PUBLICATIONS

A printout of an archived internet page from www.strappad.com (dated Dec. 1, 2001) & an accompanying photograph and description of a device publicly disclosed and sold prior to May 11, 2008.

* cited by examiner

*Primary Examiner* — John Walters
*Assistant Examiner* — Brian Swenson
(74) *Attorney, Agent, or Firm* — Knobbe, Martens, Olson & Bear, LLP

(57) ABSTRACT

A foot support device configured for use on a snowboard includes a base having a bottom surface and an upper surface, with the bottom surface being configured to attach to a top of a snowboard. The device further includes a strap adapted for removable attachment to the upper surface of said base. In certain arrangements, the base comprises at least two loops, so that the strap is configured to be selectively routed through at least one of the loops. In one embodiment, the strap generally defines a longitudinal axis that passes through the at least two loops when said strap is secured to the base. The base and the strap can define an opening for at least partially receiving a boot therein. In other arrangements, the base comprises a plurality of upwardly extending protruding members configured to provide traction to a boot positioned thereagainst. In some embodiments, the base is generally symmetrical about the longitudinal axis, thereby permitting the foot support device to be properly functional in either a regular or a goofy orientation.

17 Claims, 19 Drawing Sheets

FOOT SUPPORT DEVICE

CROSS-REFERENCE TO RELATED APPLICATIONS

This application claims the priority benefit under 35 U.S.C. §119(e) of U.S. Provisional Application No. 61/177,164, filed May 11, 2009, the entirety of which is hereby incorporated by reference herein.

BACKGROUND OF THE INVENTIONS

1. Field of the Inventions

The present inventions relate to a support device configured for attachment to a separate member and, more particularly, to a foot support device for use on snowboards and similar devices.

2. Description of the Related Art

When riding a chairlift, a snowboarder typically removes his or her rear foot from the corresponding binding of the board, while the front foot remains positioned within the front binding. Under such circumstances, the user's front foot becomes solely responsible for accommodating all or substantially all of the weight of the cantilevered or hanging snowboard. As a result, stresses, strains and/or other loads are exerted on a user's foot, ankle, knee, hip and/or other portions of his or her anatomy, potentially causing discomfort and/or injury. Further, boarders are expected to get off the lift and glide down an unloading ramp. This task can be challenging when only the snowboarder's front boot is secured into the corresponding board binding. Thus, the ability of snowboarders to change directions, stop and/or otherwise control their boards can be greatly diminished when only one foot is secured to the bindings. In addition, if a snowboard is accidentally dropped, injuries and other types of damage may result. Accordingly, a need exists for a foot support device that can be secured to a snowboard in order to address one or more of health, safety and other concerns.

SUMMARY OF THE INVENTIONS

According to some embodiments of the present inventions, a foot support device configured for use on a snowboard includes a base having a bottom surface and an upper surface, with the bottom surface being configured to attach to a top of a snowboard. The device further includes a strap adapted for removable attachment to the upper surface of said base. In certain arrangements, the base comprises at least two loops, so that the strap is configured to be selectively routed through at least one of the loops. In one embodiment, the strap generally defines a longitudinal axis that passes through the at least two loops when said strap is secured to the base. The base and the strap can define an opening for at least partially receiving a boot therein. In other arrangements, the base comprises a plurality of upwardly extending protruding members configured to provide traction to a boot positioned thereagainst. In some embodiments, the base is generally symmetrical about the longitudinal axis, thereby permitting the foot support device to be properly functional in either a regular or a goofy orientation.

According to other arrangements, the protruding members located near a periphery of the base are generally taller than protruding members positioned near a center of the base. In certain embodiments, the base is configured to be attached to a snowboard using an adhesive. In one embodiment, the adhesive is positioned along the bottom surface of the base. In another arrangement, the adhesive is selectively exposable using a peel-away liner. In some configurations, the base comprises polyethylene and/or some other thermoplastic. In certain embodiments, the strap comprises nylon, another type of plastic and/or any other suitable material. According to other arrangements, the strap comprises hook-and-loop fasteners for adjusting an effective length of said strap. In some embodiments, the protruding members comprise a generally conical shape. In one arrangement, the base additionally comprises a plurality of traction lines located beneath the strap.

According to certain embodiments, a support device for attachment to a snowboard comprises a base having a bottom surface and an upper surface, with the bottom surface configured to attach to a top of a snowboard. The base can include at least two loops along its upper surface. The device additionally includes a strap configured for attachment to the loops of the base, wherein the strap generally defines a longitudinal axis through the base when said strap is attached to the two loops of the base. In some embodiments, the base and the strap define an opening for at least partially receiving a boot therein. In other arrangements, the base comprises a plurality of traction members configured to engage a lower surface of a boot positioned thereagainst. In one embodiment, a height of traction members located near a periphery of the base is generally greater than a height of traction members positioned near a center of the base. In another arrangement, the base is generally symmetrical about the longitudinal axis, thereby permitting a boot to be positioned with said support device from either side of a snowboard.

According to other arrangements, the strap is selectively removable from the loops of the base. In another embodiment, the base is configured to be attached to a snowboard using an adhesive. In other configurations, the base comprises polyethylene and/or any other thermoplastic. In one embodiment, the strap comprises nylon or another suitable plastic. In certain arrangements, the traction members comprise a generally conical shape. In one embodiment, the strap can be selectively detached from one loop of the base and reconfigured to be secured to a user's wrist.

According to certain embodiments, a method of using a support device to selectively switch between a carrying mode and a support mode comprises securing a support device to a top of a snowboard. The support device can include a base having a bottom surface and an upper surface, such that the base includes at least two loops along said upper surface. The bottom surface of the base is configured to be attached to a top of a snowboard. The device additionally includes a strap configured for attachment to at least one of the loops of the base. Under a carrying mode, the method includes securing the strap to only one of the loops of the base and forming a band with an unattached end of the strap, said band being configured to receive a user's wrist, such that a user can support the snowboard using said strap. Under a support mode, the method includes securing the strap to the two loops of the base, wherein the base and the strap generally define an opening for at least partially receiving a boot therein. Under this mode, the method additionally includes placing an unbound boot into the opening defined by the base and the strap and supporting at least a portion of a weight load of a snowboard by the unbound boot positioned within the opening. In some arrangements, the base comprises a plurality of traction members configured to engage a lower surface of a boot positioned thereagainst.

According to certain arrangements, the support mode is performed while a user is situated on a lift. In other embodiments, the loops define a longitudinal axis along the base, the support device being generally symmetrical about the longitudinal axis. In one configuration, the strap comprises hook-and-loop fasteners for adjusting an effective length of said strap.

BRIEF DESCRIPTION OF THE DRAWINGS

These and other features, aspects and advantages of the inventions disclosed herein are described below with reference to the drawings of certain preferred embodiments, which are intended to illustrate and not to limit the inventions. The drawings comprise the following figures.

DETAILED DESCRIPTION OF THE PREFERRED EMBODIMENTS

The various embodiments of the foot support device disclosed herein, as well as the various components and features associated with them, are described in the context of snowboards because they have particular utility in this context. However, the devices and methods described herein, as well as their various components and features, can be used in other contexts as well, such as, for example, but without limitation, surfboards, skateboards, other types of board and/or the like.

Figure 1A:
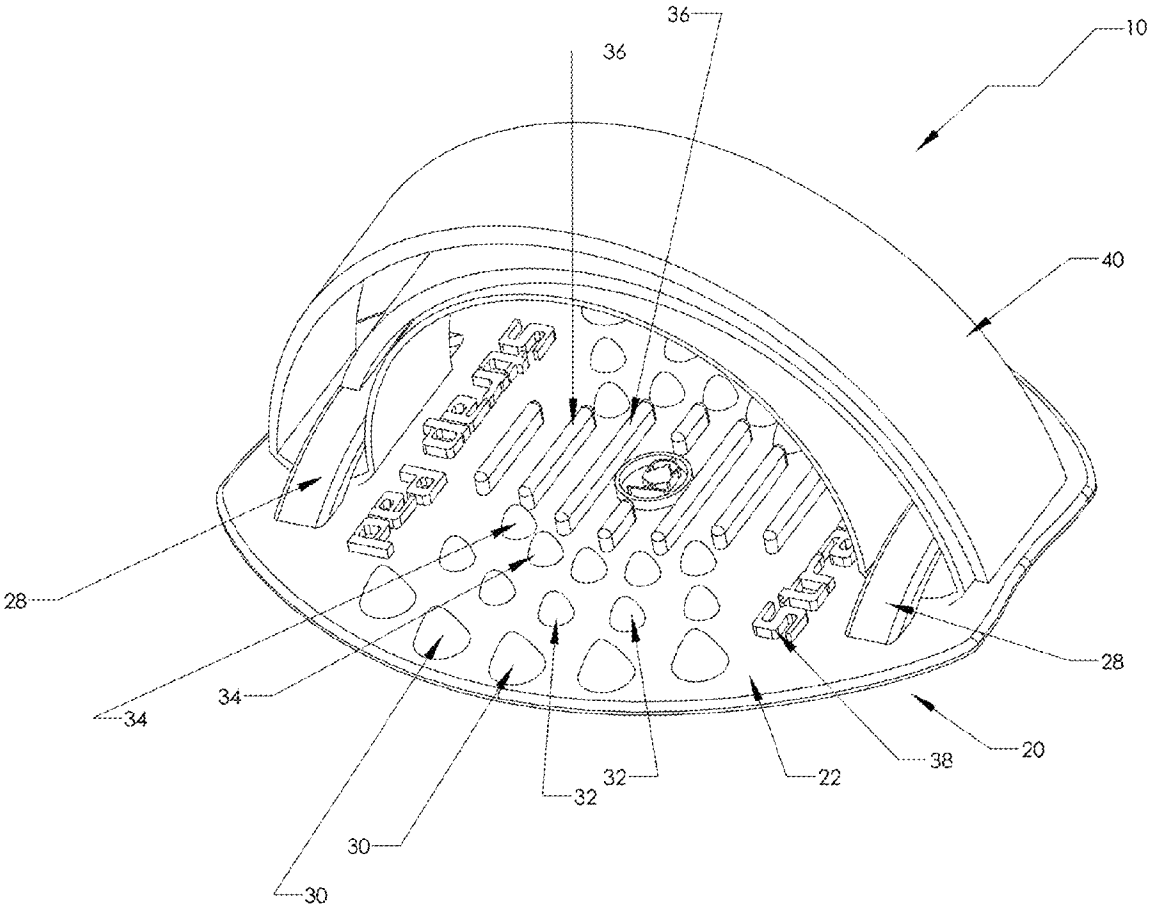
FIG. 1A illustrates a perspective view of one embodiment of a foot support device configured for use with a snowboard.

With reference to FIG. 1A, a foot support device 10 can include a base 20 having several features along its upper surface 22. For example, in the illustrated embodiment, the foot support device 10 comprises a plurality of traction lines 36 near the middle of the base 20. Further, the depicted arrangement includes a plurality of traction studs 30, 32, 34 that are oriented in generally concentric rows along either side of the traction lines 36. As discussed in greater detail herein, such traction lines 36, traction studs 30, 32, 34 and/or other protrusions can advantageously enhance traction between the upper surface 22 of the base 20 and a shoe (e.g., snowboard boot) positioned thereon.

As shown in FIG. 1A, the foot support device 10 can additionally comprise two or more loops 28 that are shaped, sized and otherwise adapted to receive a strap 40 relative to the adjacent base 20. According to certain embodiments, the size of the opening created between the strap 40 and the base 20 is adjustable, allowing the device 10 to be easily and conveniently modified to receive different sized snowboarding boots and/or other types of shoes. Further, in some arrangements, the foot support device 10 is configured so that the strap 40 can be selectively removed from the base 20. The upper surface 22 of the base 20 can comprise any other traction or non-traction member or feature, such as, for example, a logo 38 or other identifying mark.

Figure 1B:
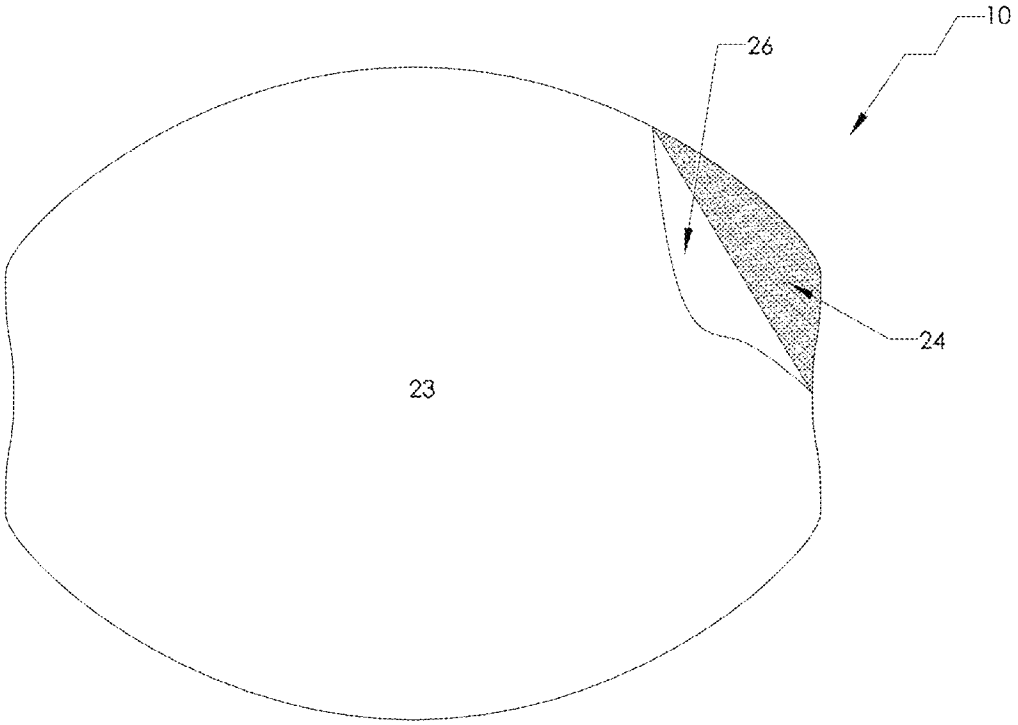
FIG. 1B illustrates a bottom view of the foot support device of FIG. 1A.
Figure 2A:
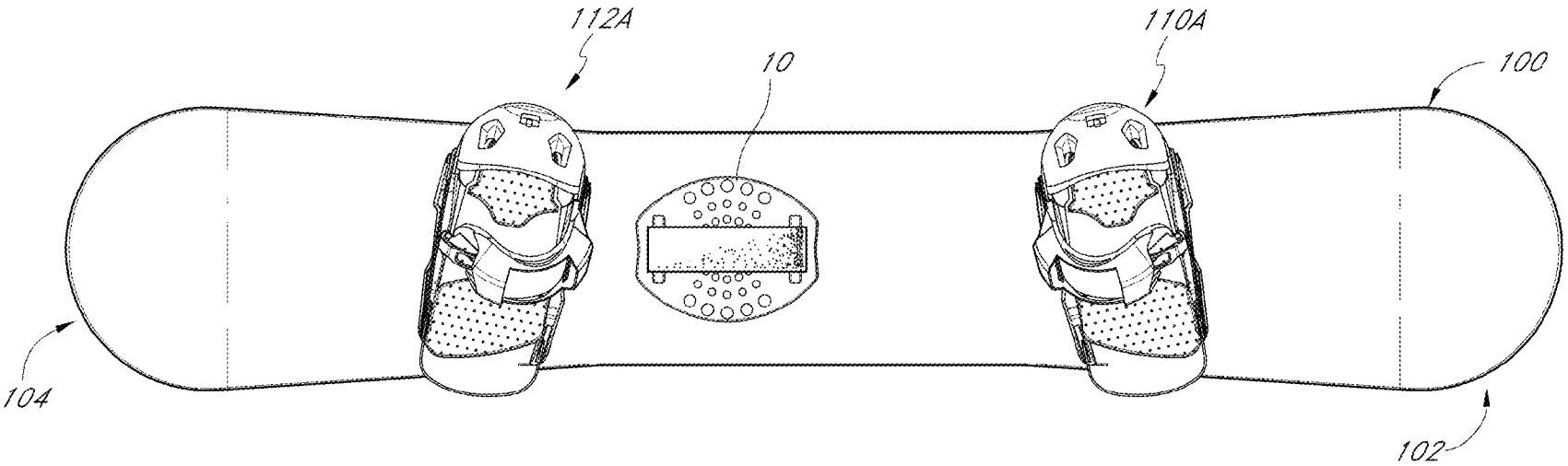
FIG. 2A illustrates a top view of the foot support device of FIG. 1A secured to a snowboard which has been configured to be used in a regular orientation.

FIG. 2A illustrates a top view of one embodiment of a foot support device 10 secured to a snowboard 100. In the depicted arrangement, the foot support device 10 is positioned on an upper surface of the snowboard 100, generally between the bindings 110, 112. The foot support device 10 can be attached to a board 100 using one or more adhesives. For example, as illustrated in FIG. 1B, the bottom 23 of the foot support device 10 can comprise a peel-away liner 26 that selectively exposes an adhesive surface 24. Thus, once the liner 26 has been removed from the bottom surface 23, the device 10 can be conveniently positioned on a desired location of the upper surface of the board 100. In other embodiments, one or more other types of connection devices or methods can be used to help secure the device 10 to a board, such as, for example, screws, other fasteners and/or the like.

According to certain embodiments, the adhesive that secures the foot support device 10 to a board 100 comprises double coated transfer tape having sufficient strength to resist the forces (e.g., shear stress) and moments to which it may be exposed during use. Further, the adhesive can also be capable of maintaining a secure connection between the foot support device 10 and the board 100 despite exposure to certain conditions and other elements, such as moisture (e.g., water, snow, humidity, etc.), dirt, mud, temperature variations (e.g., −20 to 110° F.) and/or the like. In embodiments where the base 20 of the device 10 is at least partially clear (e.g., transparent, translucent, etc.), the adhesive used can also be generally clear so at to not detract from the general design of the board 100.

As illustrated in FIG. 1B, an adhesive layer, coat or other substance can be provided along the entire or substantially the entire bottom surface 23 of the foot support device 10. Alternatively, adhesives can be included intermittently or only partially along the bottom surface 23 of the device 10, as desired or required. In other embodiments, the foot support device 10 is sold or otherwise provided without any adhesives. Thus, one or more adhesives (e.g., in loose form, as double-sided tape, etc.) can be used to attach the device 10 to a snowboard 100 or any other device.

Figure 2B:
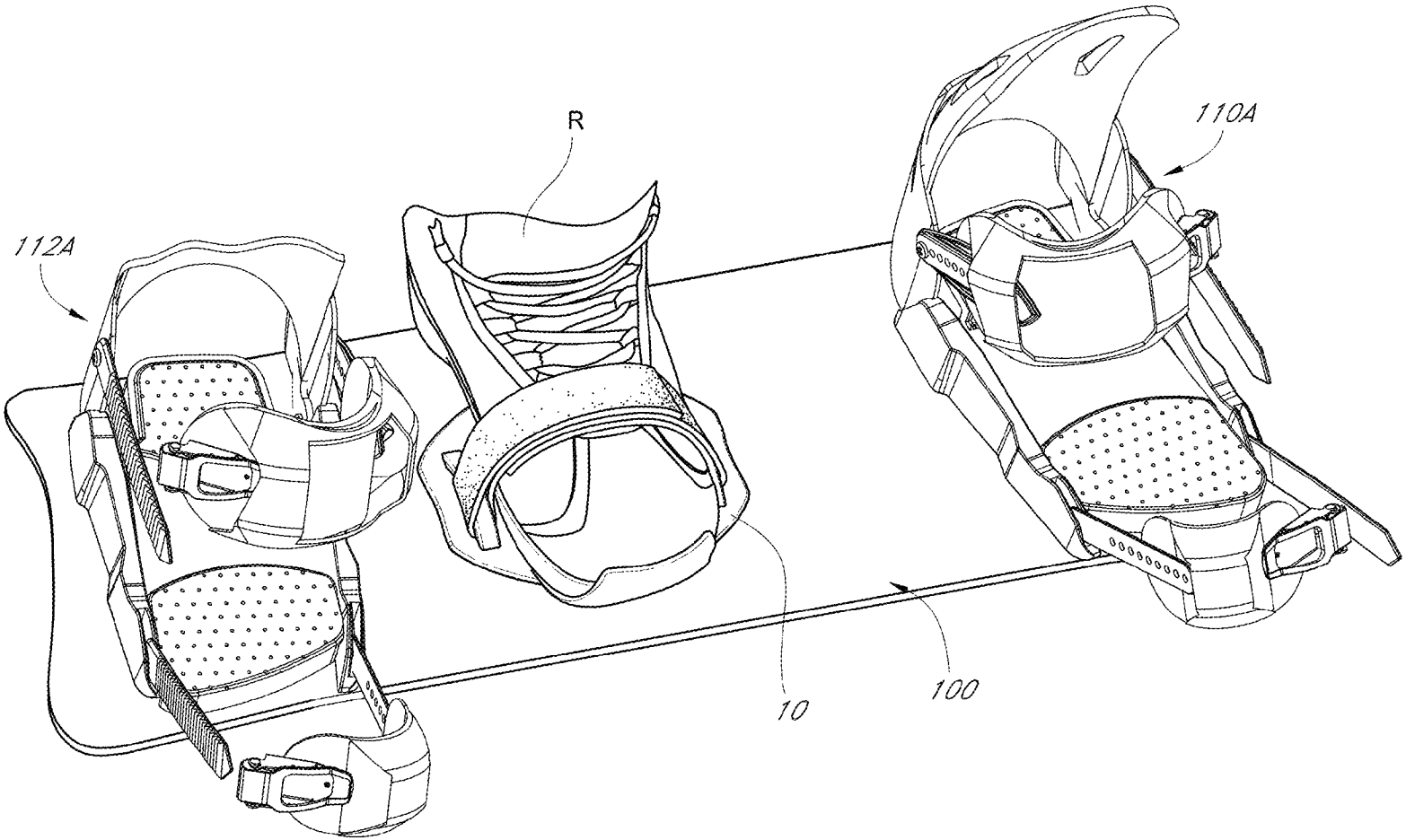
FIG. 2B illustrates a perspective view of an unbound snowboarding boot positioned within the foot support device of FIG. 2A.

With continued reference to FIG. 2A, the board 100 to which the foot support device 10 is secured comprises a "regular" orientation, i.e., the user rides with his or her left foot (to be inserted into binding 110A) toward the front 102 of the board. In the depicted arrangement, the foot support device 10 is positioned between the two bindings 110A, 110B, closer to the rear binding (e.g., right-foot binding 112A). However, a user can position the device 10 at any other location of the board 100 (e.g., generally halfway between the left-foot binding 110A and the right-foot binding 112A, closer to the left-foot binding 110A, etc.), in accordance with his or her own preferences. Regardless of its exact position along the board 100, the foot support device 10 can be configured to advantageously receive a user's boot that is not secured within a binding 110A, 112A. For example, as illustrated in FIG. 2B, a user can position his or her right snowboarding boot R within the foot support device 10.

As noted above, when riding a chairlift, a snowboarder typically removes his or her rear foot from the corresponding binding of the board, while the front foot is positioned within the front binding. Thus, with specific reference to the embodiment illustrated in FIGS. 2A and 2B, the user's right boot R is removed from the rear binding 112A, and the user's left boot L remains secured to the front binding 110A. Under such circumstances, the user's front foot becomes solely responsible for accommodating all or substantially all of the weight of the cantilevered or hanging snowboard 100. Accordingly, stresses, strains and/or other loads are exerted on a user's foot, ankle, knee, hip and/or other portions of his or her anatomy. This may lead to discomfort, injury and/or other undesirable consequences, especially due to the repetitive nature of the exposure.

The various embodiments disclosed herein can help to at least partially alleviate this uneven loading problem by allowing users to insert their unbound boot within the foot support device 10. As a result, the weight of the board and its various components (e.g., bindings) can be advantageously distributed to both of the user's legs.

Relatedly, such arrangements of a support device can also assist a user to properly dismount from a chairlift. Typically, snowboarders are expected to get off the chairlift and glide down an unloading ramp. This task can be challenging and potentially dangerous when only the snowboarder's front boot is secured into a board binding. Accordingly, the ability of snowboarders to change directions, stop and/or otherwise control their boards can be greatly diminished when attempting to exit the chairlift. Thus, by at least temporarily securing his or her unbound boot to a foot support device 10, a snowboarder can more safely and effectively stop, steer and otherwise maneuver the board after he or she dismounts from the chairlift.

As discussed in greater detail herein, the foot support device 10 can also provide additional benefits and advantages to a snowboarder. For example, the strap 40 of the device 10 can be reconfigured as a wrist leash or a handle. Accordingly, the device 10 can be used to facilitate carrying a board up or down a slope. This can help the comfort level of a boarder and/or improve the safety at a snowboarding site, as the likelihood of injury to persons and/or damage to surrounding property resulting from an inadvertently dropped board can be advantageously reduced. In addition, using the foot support device 10 as a handle can facilitate grasping, carrying and otherwise manipulating a board, as a snowboarder can avoid grabbing a board by its edges, which typically are relatively sharp and uncomfortable.

Figure 3A:
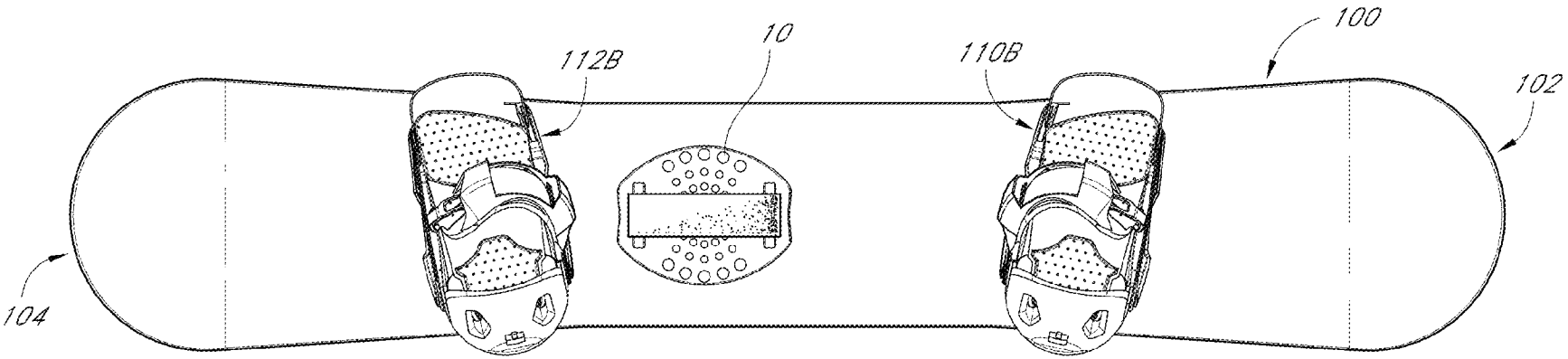
FIG. 3A illustrates a top view of the foot support device of FIG. 1A secured to a snowboard which has been configured to be used in a goofy orientation.
Figure 3B:
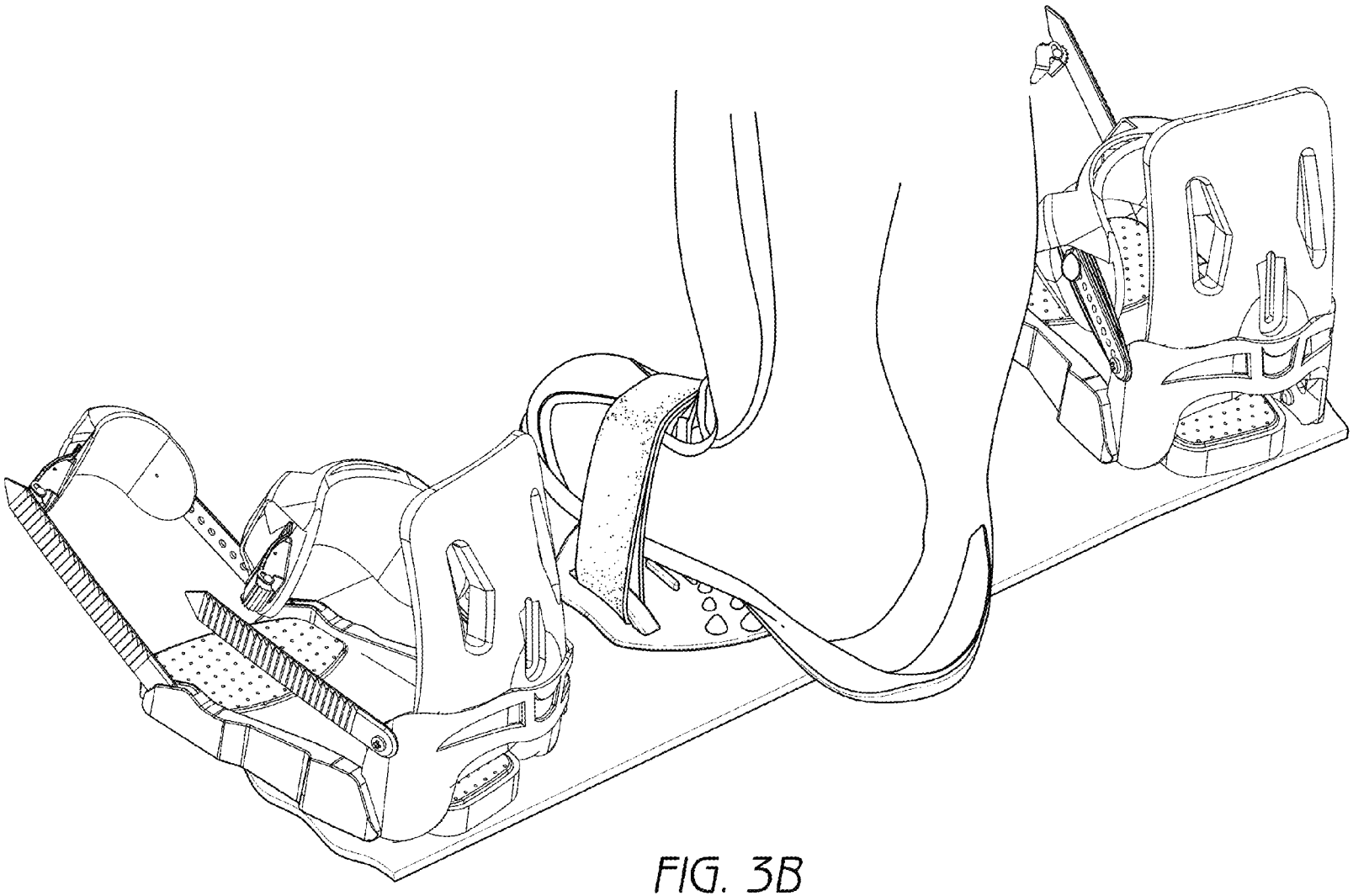
FIG. 3B illustrates a perspective view of an unbound snowboarding boot positioned within the foot support device of FIG. 3A.

Once secured to a snowboard, the function of the foot support device 10 can be retained even if the bindings are reversed. For example, some users prefer to ride their boards in a "goofy" orientation, meaning that the user leads with his or her right foot. Thus, as illustrated FIG. 3A, under such a stance, a user secures his or her right boot into the binding 110B located closer to the front end 102 of the board 100. In the depicted arrangement, the foot support device 10 is in the identical position that it was when the board was configured for a regular orientation (FIGS. 2A and 2B). However, due to its symmetrical or substantially symmetrical design, the device 10 is still capable of receiving a user's unbound boot (FIG. 3B). In some arrangements, the device 10 is symmetrical about the strap 40 that is removably secured to the device at the loops located along opposite ends of the base 20. Accordingly, even though the position of the bindings 110, 112 can be reversed in order to selectively accommodate a regular or a goofy stance, the foot support device 10 remains fully effective and functional without the need to modify its position along the board 100. This can be particularly important for snowboarders who wish to switch between regular and goofy stances or for rented snowboards that are frequently reconfigured to a customer's specific preferences.

Various views of one embodiment of a base 20 of a foot support device 10 are illustrated in FIGS. 4A-4D. In the depicted arrangement, the base 20 includes a generally oval or rounded outer shape. However, the base can have any other desired shape, such as, for example, square, rectangular, other polygonal, circular, irregular and/or the like. For instance, the base 20' illustrated in FIGS. 5A and 5B comprises a generally octagonal shape. In one embodiment, the base 20 is approximately 7.4 inches wide and 6.0 inches long. In other arrangements, the width and/or length of the base can be greater or less than these dimensions. The base 20 can be advantageously sized, shaped and otherwise configured so that it can adequately accommodate snowboarding boots, shoes and/or other devices of different types, sizes and general configurations. For example, the spacing between the strap-receiving loops 28 can be sufficiency large to permit boots of various widths to be positioned therebetween. In one embodiment, the distance between the loops 28 is approximately 4.9 inches. However, in alternative arrangements, the distance separating the loops 28 can be greater or less than 4.9 inches, as desired or required.

According to certain embodiments, the base 20 of foot support device 10 comprises one or more thermoplastic materials, such as, for example, polyethylene, polypropylene and/or any other polymeric materials. However, the base 20 can comprise other types of materials, either in addition to or in lieu of thermoplastics. For instance, the base can include rubber, paper-based or wood-based materials, metals, alloys, additives, binders, dyes, coatings, other natural or synthetic materials and/or the like, as desired or required for a particular application or use. The base 20 can be manufactured using injection molding methods. Alternatively, any other type of molding and/or manufacturing method can be used to help produce the base 20 into a desired shape, such as, for example, compression molding, thermoforming, casting, cutting and/or the like.

The base 20 and/or any other components of the foot support device 10 can be completely or at least partially transparent, translucent and/or otherwise clear. Such configurations provide for better integration of the foot support device 10 with the snowboard, as any graphics present on the adjacent surface of the board will not be greatly detracted or otherwise disrupted by the device 10. Alternatively, the base 20 can have one or more opaque regions or other areas that are not configured to be clear.

With continued reference to FIGS. 4A-4D, the base 20 can include a plurality of traction studs 30, 32, 34 or other protruding members that generally extend upwardly from the top surface 22. In some arrangements, the studs 30, 32, 34 form a unitary structure with the base 20. For instance, the traction studs can be produced when the base 20 is injection molded. In other configurations, the traction studs 30, 32, 34 are separate items that are subsequently attached to the base 20 using one or more connection methods or devices, such as, for example, adhesives, fasteners, hot melting and/or the like.

In the depicted embodiment, the traction studs 30, 32, 34 have a generally conical shape, such that the diameter or other cross-sectional dimension of the traction studs decreases with increased height away from the top surface 22 of the base 20. Further, in this configuration, the studs 30, 32, 34 are arranged in groups of five generally within different arc-shaped rows 31, 33, 35. As shown, the rows 31, 33, 35 are concentrically disposed along the top surface of the base 20, with three of the rows having a generally opposite and symmetrical orientation relative to the other three rows. Further, the shape, size and/or other characteristics can vary from stud to stud. For example, in FIGS. 4A-4D, the traction studs 30 or other protrusions located along the outer periphery of the base (e.g., along dashed line 31), are generally bigger (e.g., wider, taller, etc.) than the studs 32, 34 located closer to the center of the base 20. Such a configuration can provide certain benefits.

In other embodiments, the quantity, size, shape, location along the base, orientation and spacing relative to each other and other components of the base and/or other characteristics of the studs 30, 32, 34, lines 36 and/or any other traction feature of a foot support device 10 are different than illustrated and discussed with reference to the arrangements disclosed herein. For example, a base 20 can include additional or fewer traction studs. In other configurations, a base can include studs 30, 32, 34 of varying overall shape.

As discussed herein and illustrated in FIGS. 2B and 3B, a foot support device 10 can be shaped, sized and otherwise configured to receive a snowboarding boot or other type of shoe generally within an opening generally defined between the base 20 and the adjustable strap 40. Once a boot is properly positioned within the device 10, the larger studs 30 located along the outer periphery of the base 20 can engage the heel and toe portions of the boot. Under such a configuration, the best traction interface between the boot and the foot support device 10 generally occurs along the outer periphery of the base 20. Thus, the turning forces and other moments that can be imparted to the board by the unbound foot through the device 10 are generally increased. Accordingly, a snowboarder's ability to steer and otherwise maneuver the board can be advantageously improved. This can be particularly important when a snowboarder exits a ski lift onto a ramp or other difficult area where it is desirable to maintain some level of control and maneuverability in the board.

With continued reference to FIGS. 4A-4D, the smaller studs 32, 34 and traction lines 36 located along an interior of the base 20 can also provide traction for a boot positioned within the foot support device 10. In addition, the traction studs 30, 32, 34, lines 36 and/or any other surface feature the foot support device 10 can help maintain a bottom surface of a snowboarding boot or other shoe generally above the snow, ice, mud and any other debris that may accumulate on the base 20, thereby further improving the moments and forces that can be imparted on a snowboard through the foot support device 10.

Figure 4A:
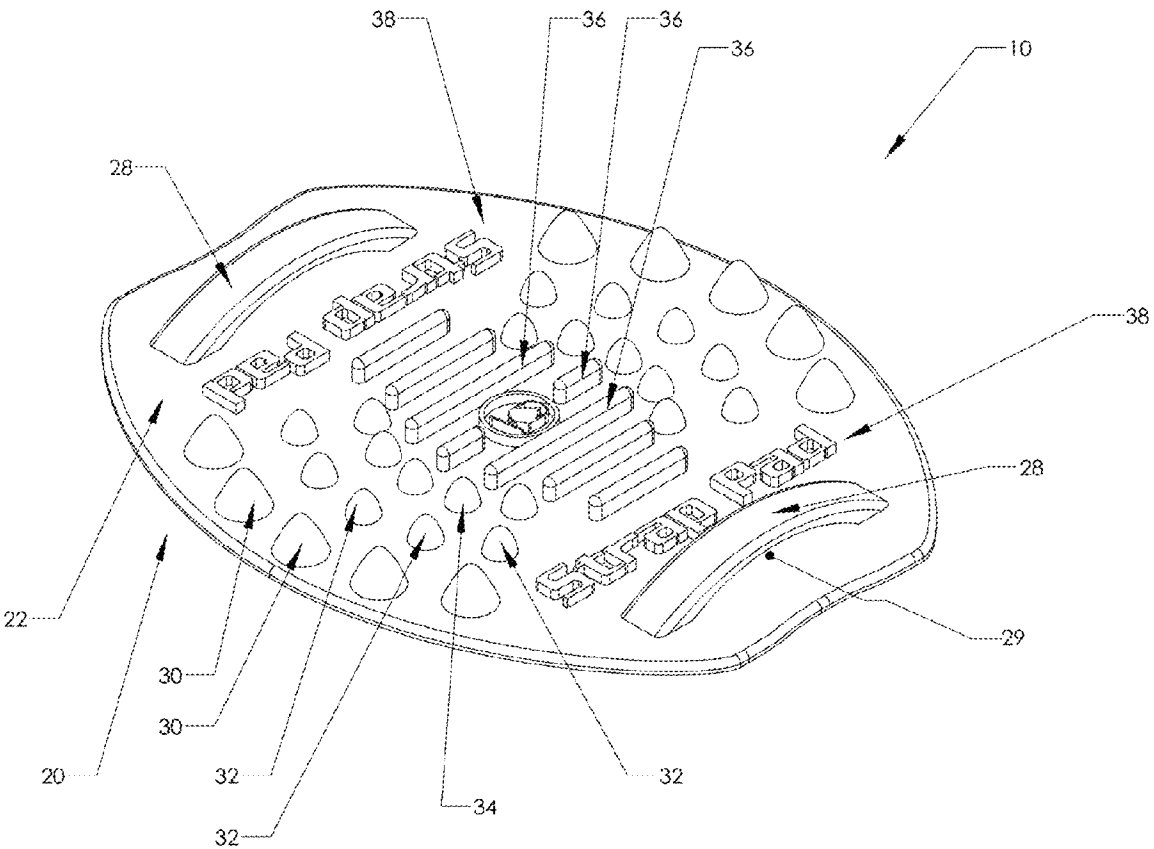
FIG. 4A illustrates a perspective view of a base of a foot support device according to one embodiment.
Figure 4B:
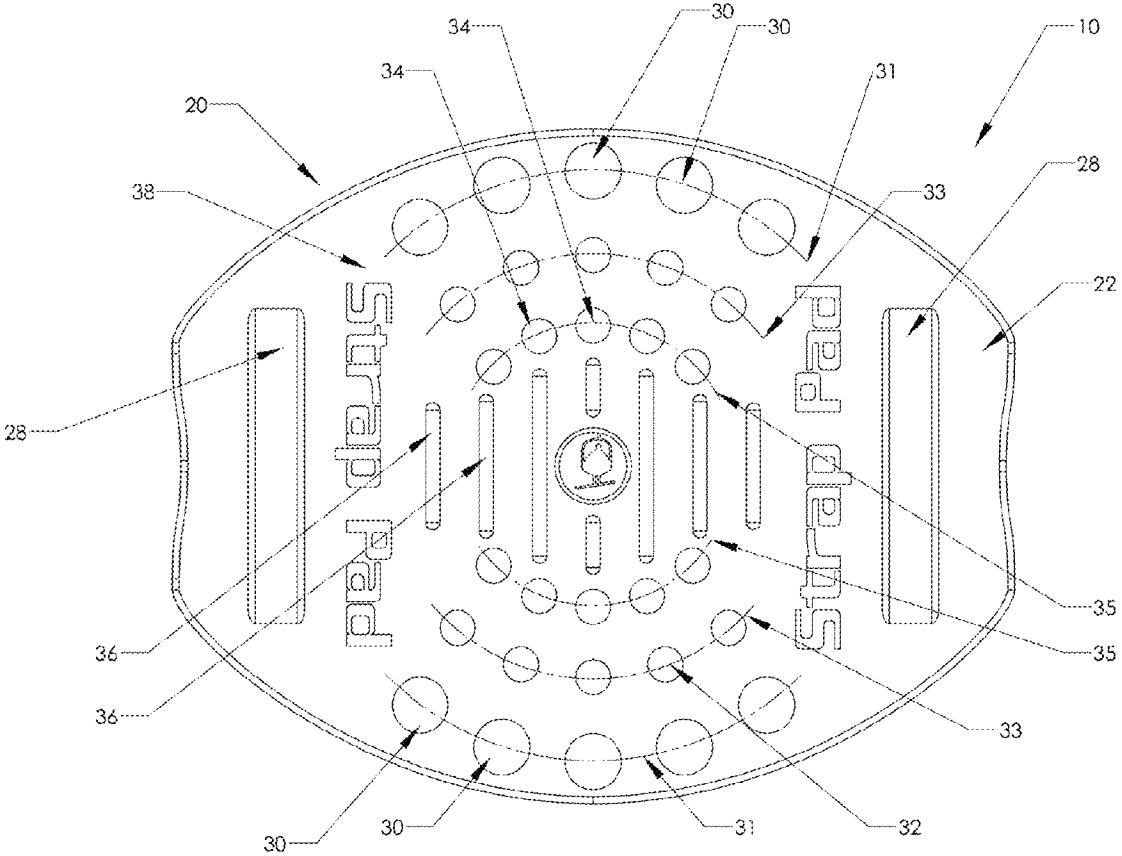
FIG. 4B illustrates a top view of the base of FIG. 4A.
Figure 4C:
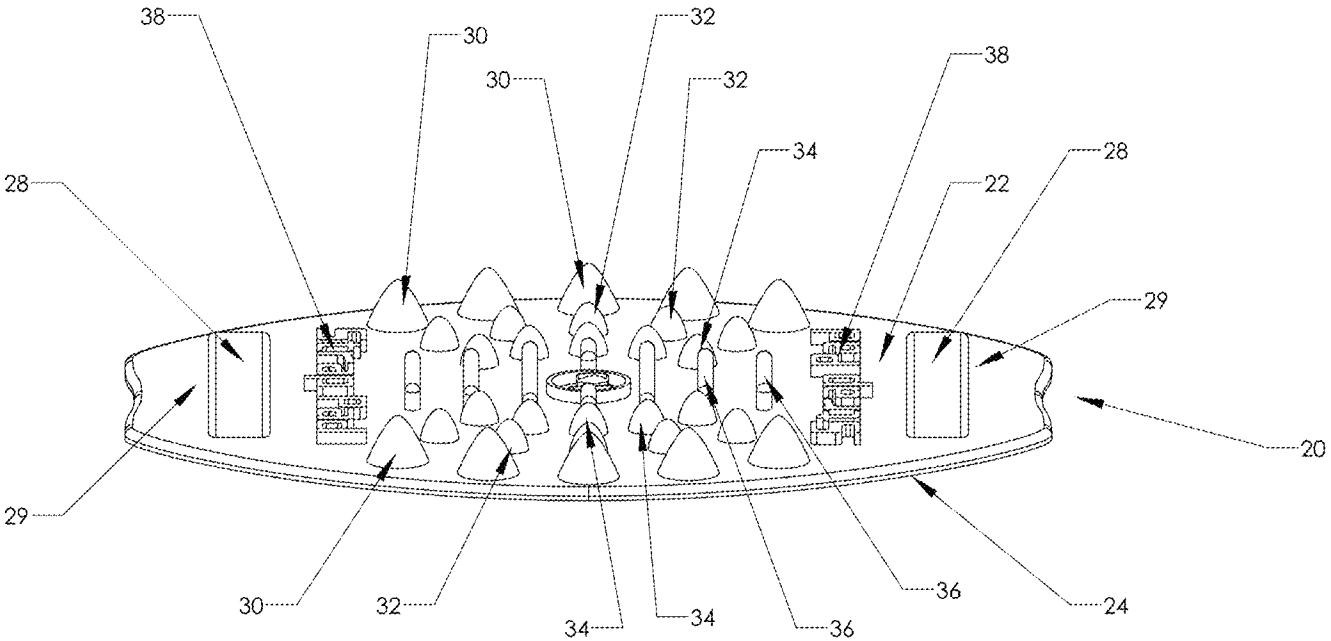
FIG. 4C illustrates a different perspective view of the base of FIG. 4A.
Figure 4D:
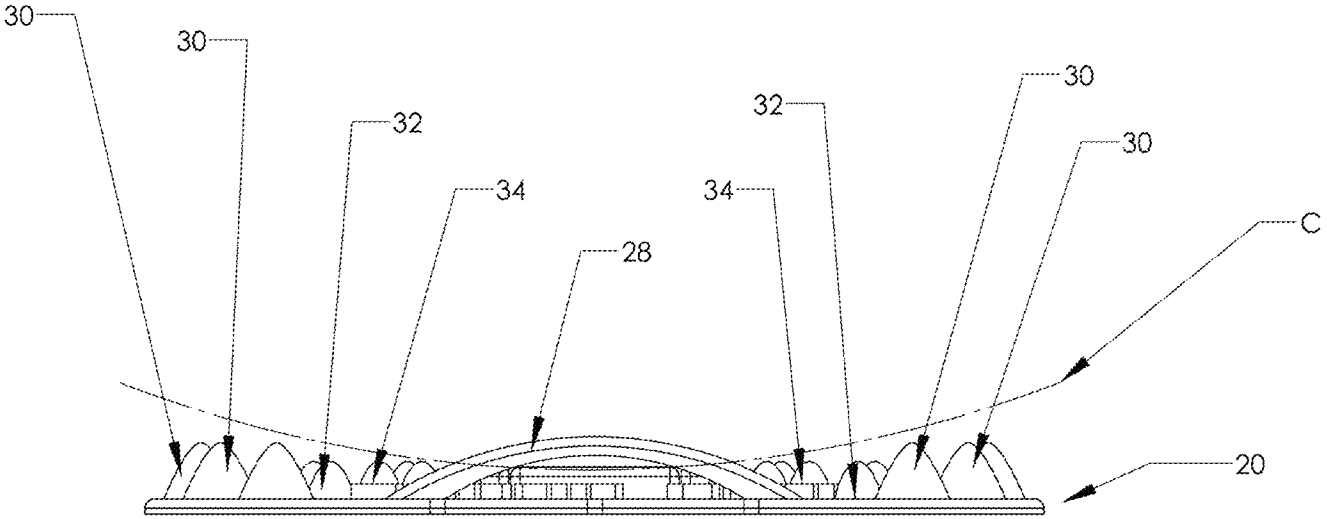
FIG. 4D illustrates a side view of the base of FIG. 4A.
Figure 5A:
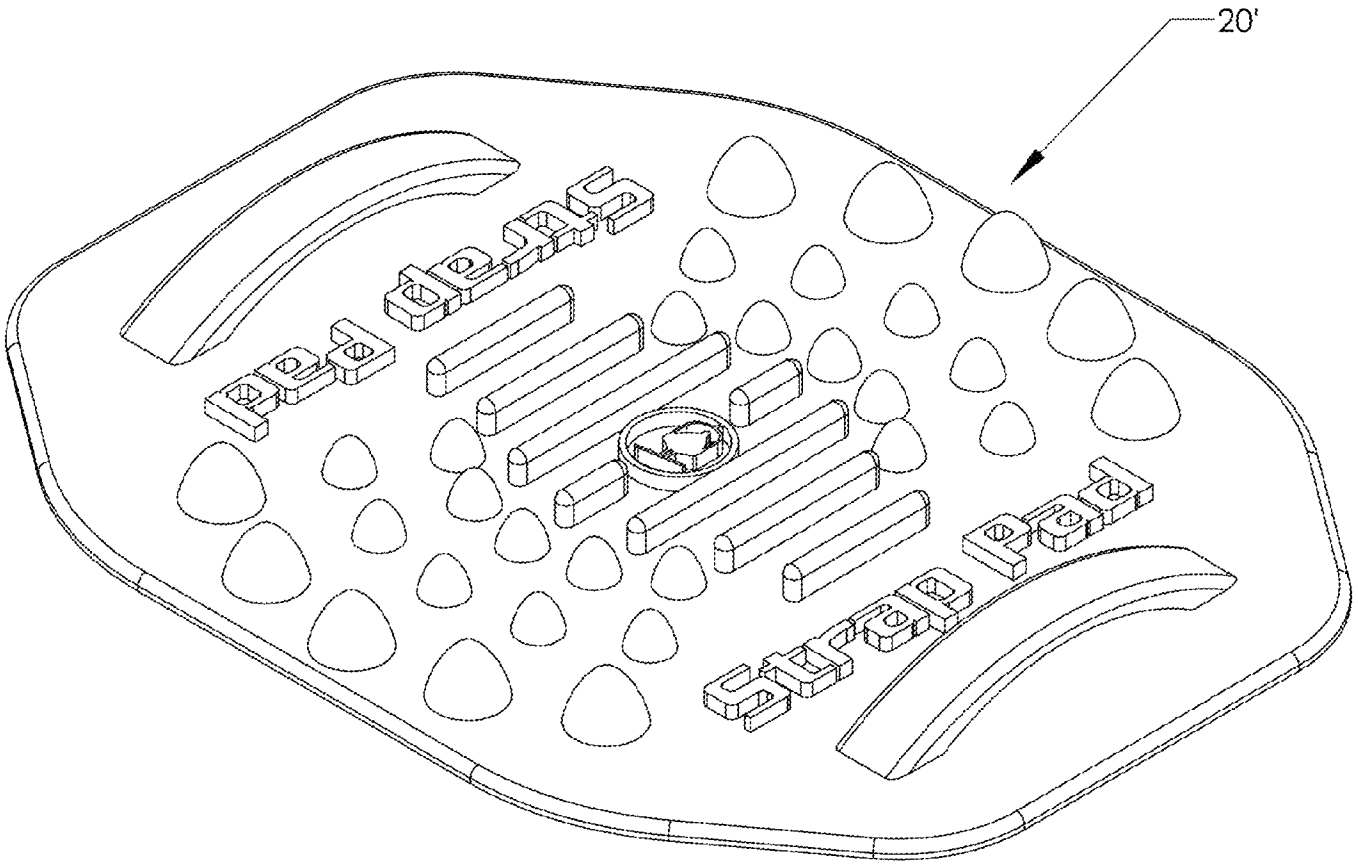
FIG. 5A illustrates a perspective view of a base of a foot support device according to a different embodiment.
Figure 5B:
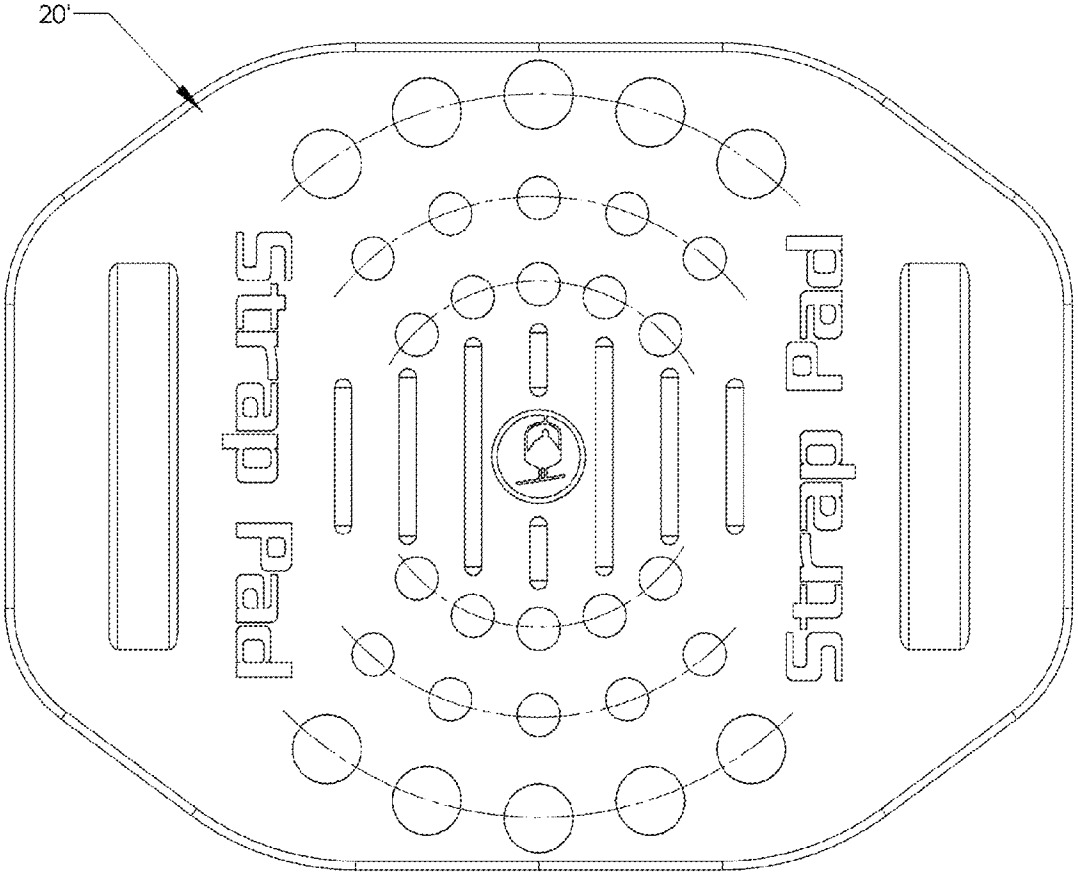
FIG. 5B illustrates a top view of the base of FIG. 5A.

As illustrated in the side view of FIG. 4D, traction studs 30, 32, 34, lines 36 and any other protruding feature extending from the base 20 of the foot support device 10 can have a generally contoured profile (e.g., generally represented by dashed line C). In certain embodiments, a contoured profile C can facilitate placement of a boot or other shoe within (and/or removal from) the support device 10, while still providing the desired level of traction to a user once a boot has been positioned within the device. For example, such a profile can help ensure that a front portion of a boot or other shoe is not obstructed by traction studs and/or other features extending from the base 20.

As discussed in greater detail herein, the symmetrical nature of the foot support device 10 can provide certain benefits. For example, a snowboarding boot or other shoe can be inserted into the device 10 from one of two directions. Thus, once the device 10 is attached to a snowboard, it does not need to be removed and repositioned to accommodate a change in the user's boarding stance (e.g., regular, goofy, etc.). According to certain arrangements, the device 10 is generally symmetrical about a longitudinal line extending between the strap-receiving loops of the base (and thus, the strap when it is properly positioned therethrough).

Figure 6:
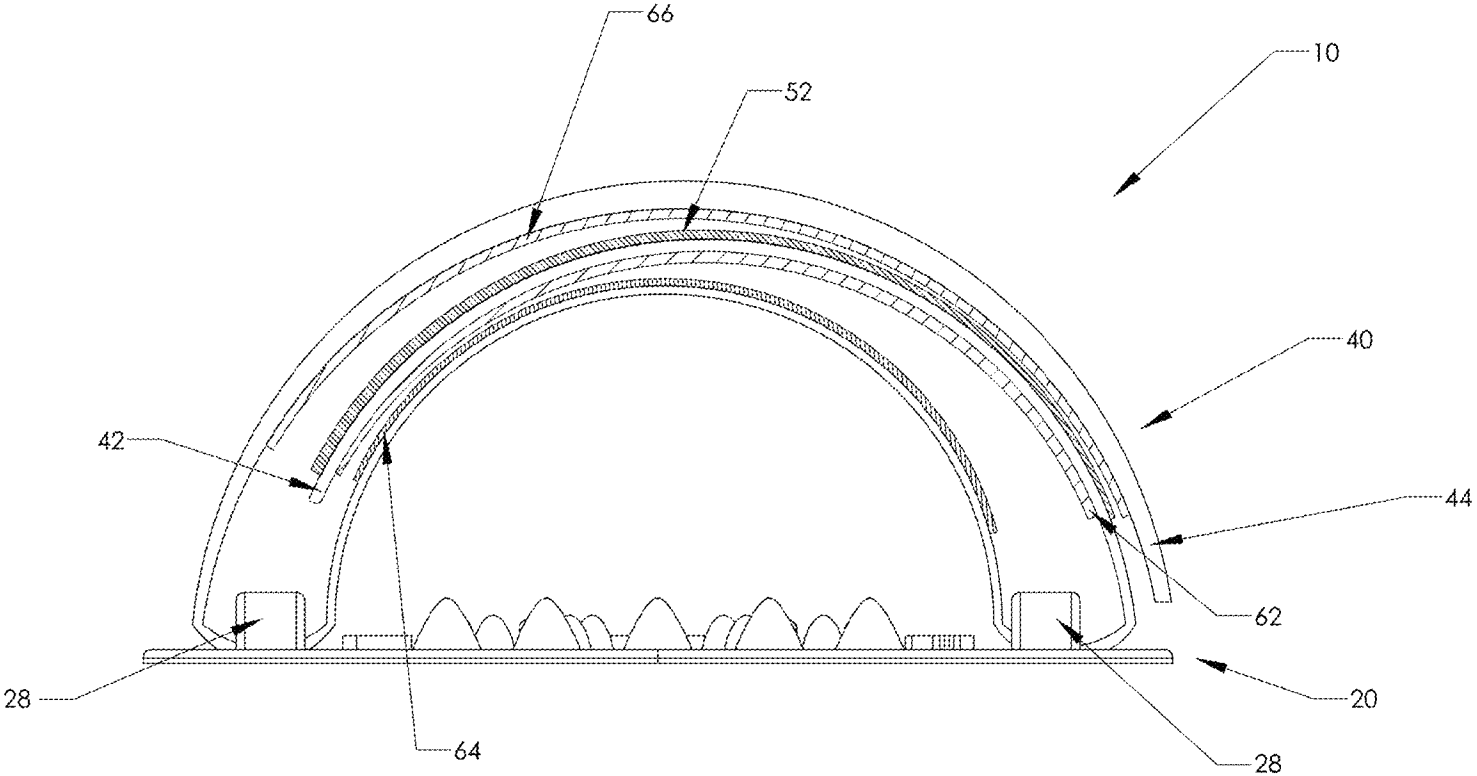
FIG. 6 illustrates a side view of one embodiment of a foot support device having a removable strap.

FIG. 6 illustrates a side view of one embodiment of a foot support device 10 having a strap 40 secured to the base 20. As shown, the strap 40, which has been passed through the loops 28 of the base 20, can be folded on itself (e.g., once, twice, or more times, as desired or required). Accordingly, due to such folding, certain sections of a strap 40 can include two, three or more layers. In certain embodiments, selected portions of the upper and/or lower surfaces of the strap 40 include hook-and-loop fasteners (e.g., VELCRO®) and/or other connection features, thereby allowing at least some adjacent surfaces of the strap to be temporarily secured to each other. Such connection features permit the strap to be adjustable (e.g., to vary the size of the opening through which a boot or other shoe is positioned) and/or removable from the base 20. As a result of this adjustability, the strap 40 can be easily and quickly customized based on a particular boot size and/or a user's general preferences. The strap 40 can comprise nylon, polyvinyl chloride (PVC), polyethylene, other thermoplastics and/or any other material that provides the desired durability, strength and flexibility to the device 10.

As noted above, the strap 40 can be configured to be removable from one or both loops 28 of the base 20. This can provide certain benefits and advantages to a foot support device 10. For example, rented snowboards are regularly fed through automatic grinding or other resurfacing machines in order to maintain a desired smoothness level along their lower surfaces. Although able to generally accommodate low profile features along the top a snowboard (e.g., the base 20 of the foot support device), such grinding machines are typically incapable of dealing with a strap 40 or other higher profile components. Thus, the straps 40 can be conveniently removed prior to a resurfacing procedure in order to permit snowboards to be automatically sanded or otherwise resurfaced. This is especially important for boards that are subjected to frequent use, such as those supplied by rental shops. If the strap 40 was not removable from the loops, and thus separable from the base 20, the support device 10 would need to be removed prior to passing a board through an automatic resurfacing apparatus. Alternatively, in such a situation, the snowboard would need to be manually resurfaced. Such alternatives can be relatively time-consuming and labor intensive.

With continued reference to FIG. 6, the strap 40 can include a first end 42 and a second end 44, which, in one folded configuration, is generally positioned above the first end 42. As shown, adjacent surfaces near the first and second ends 42, 44 of the strap 40 can comprise hook-and-loop type fasteners 52, 66 so that they can be selectively attached to each other. In addition, other sections of the strap 40 can also include such fasteners 62, 64 and/or other attachment features or devices. For example, as illustrated in FIG. 6, the section located near the first end 42 of the strap can be secured to adjacent strap portions both along its top and bottom surfaces. As noted herein, such a configuration can permit a user to quickly and easily make length adjustments to the strap 40 and/or completely remove the strap 40 from the base 20.

Figure 7A:
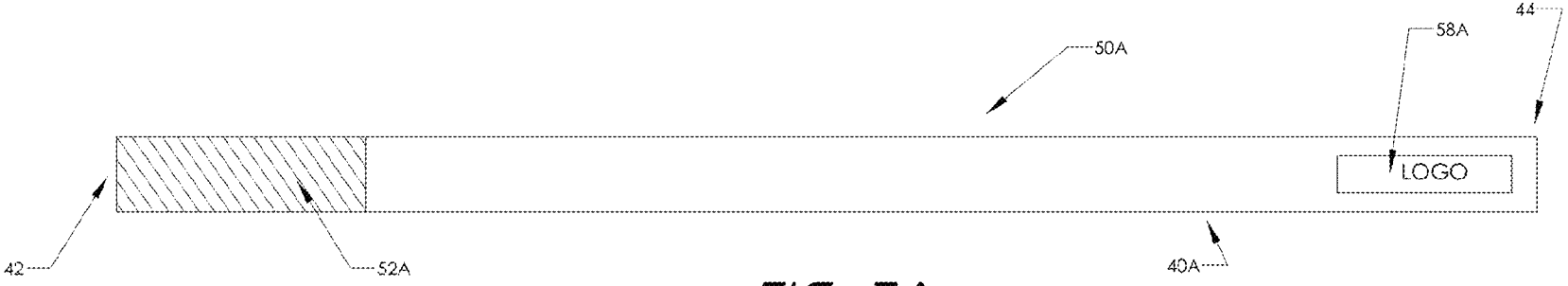
FIGS. 7A, 7B and 7C illustrate top, bottom and side views, respectively, of a strap configured for use with a foot support device according to one embodiment.
Figure 7B:
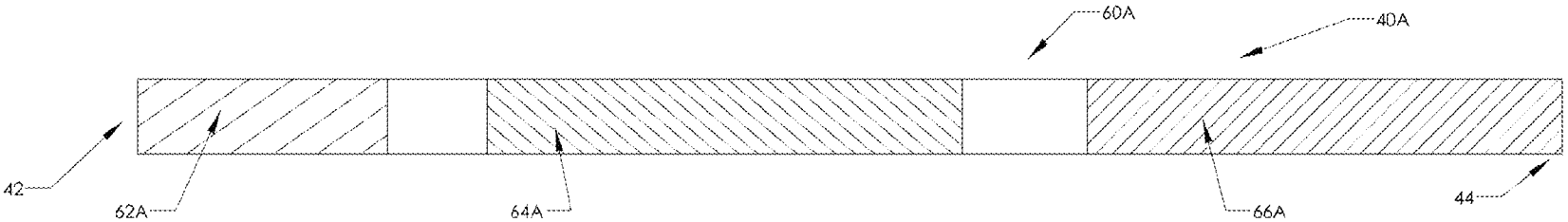
Figure 7C:
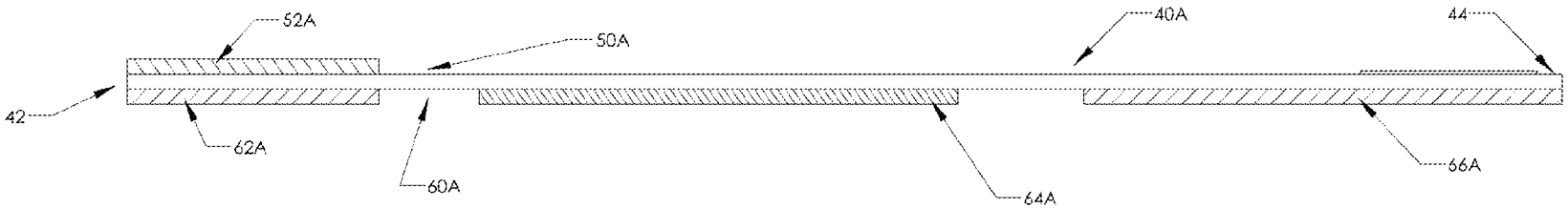
Figure 8A:
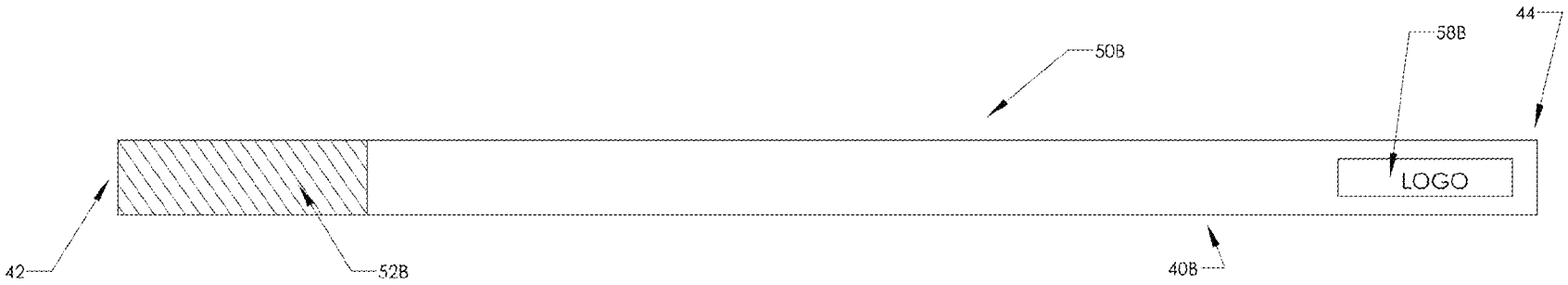
FIGS. 8A, 8B and 8C illustrate top, bottom and side views, respectively, of a strap configured for use with a foot support device according to another embodiment.
Figure 8B:
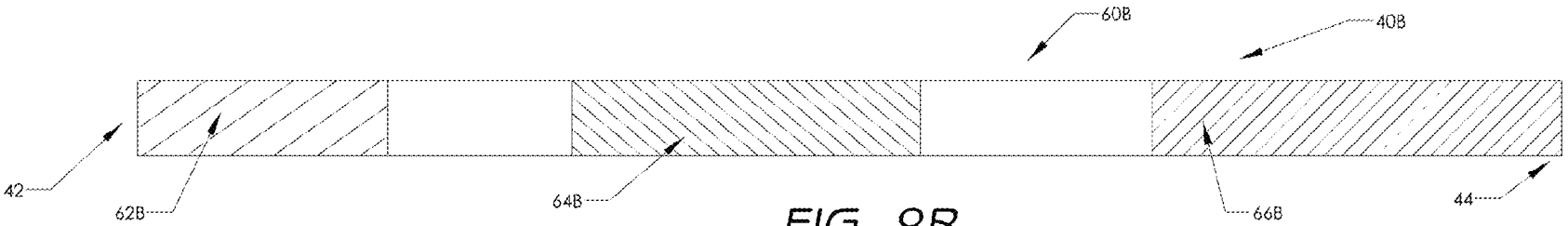
Figure 8C:
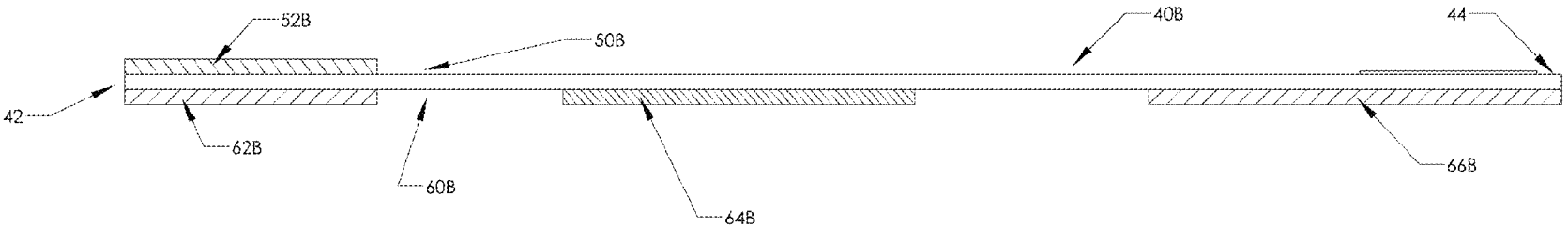

Top, bottom and side views of one embodiment of a strap 40A configured for use with a foot support device are illustrated in FIGS. 7A, 7B and 7C, respectively. According to certain embodiments, the strap 40 is approximately 30 inches long and 1½ inches wide. However, in other arrangements, the length can be greater or less than 30 inches, and the width can be greater or less than 1½ inches, as desired or required. For instance, in the configuration illustrated in FIGS. 8A-8C and discussed in greater detail below, the length of the strap 40B is approximately 28½ inches.

With continued reference to FIGS. 7A-7C, the top and/or bottom surfaces 50A, 60A of the strap 40A can comprise one or more hook portions 62A, 66A that are configured to selectively engage and removably secure to corresponding loop portions 52A, 64A of the same strap 40. For example, the depicted strap 40A can be passed through the loops 28 of a base and generally shaped in accordance with the embodiment of FIG. 6. In other arrangements, the location of the hook-and-loop portions can be reversed and/or rearranged, as desired or required. Further, one or more other types of attachment systems can be used (e.g., zippers, laces, etc.), either in lieu of or in addition to hook-and-loop fasteners. Moreover, one or more portions 58A of the strap 40A can include stitching, a label or any other item or feature adapted to display text (e.g., product or company name, warnings, etc.), a logo, an advertisement and/or the like.

By way of example, in one embodiment, the length of each of the hook-and-loop portions 52A, 62A, 64A, 66A is approximately 8 inches. However, the length of one or more of these portions can be greater or less than 8 inches. In addition, the lengths of at least some of the hook-and-loop portions can be different from each other. For instance, in the embodiment illustrated in FIGS. 8A-8C, the hook-and-loop portions 52B, 62B located along the first end of the strap 40B are approximately 5 inches long, while the other hook-and-loop portions 64B, 66B are approximately 9½ inches long. Further, as illustrated in FIGS. 7A-7C and 8A-8C, the strap 40A, 40B can include a logo 58A, 58B, name, advertisement, display and/or other identifying design along one or more of its surfaces.

Figure 9:
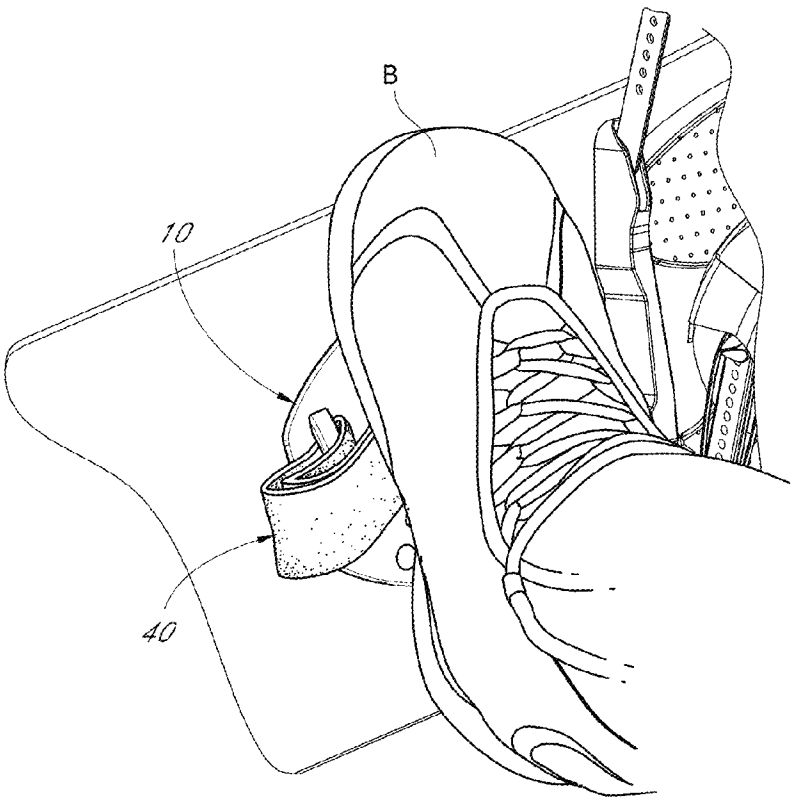
FIG. 9 illustrates a top perspective view of one embodiment of a foot support device being used as a stomp pad.

In other embodiments, as illustrated in FIG. 9, a user can use the device 10 as a stomp pad in order provide some limited control of the snowboard without having to secure the boot B or other shoe underneath the strap 40. As shown, a user can simply exert a downward force on the device 10 with his or her snowboarding boot B so as to engage the studs, lines and/or other gripping features or members along the upper surface of the base to provide some traction for steering and otherwise manipulating the snowboard. However, regardless of whether a boot is positioned within the space created by the strap or on top of the base (e.g., without inserting the boot underneath the strap), a user should use caution to not rely on the foot support device 10 for normal snowboarding activities. As discussed in greater detail herein, the various embodiments of the device 10 should only be used as a temporary attachment method to assist a user in certain unique situations (e.g., riding a chairlift, getting off a chairlift, carrying a snowboard, etc.). Accordingly, the device 10 is not intended to be used as a substitute for a snowboard binding and should not be used as such.

In certain embodiments, the studs 30, 32, 34 or other protruding members extending from the upper surface of the base 20 are oriented in a manner than enhances the traction between the device 10 and a snowboarding boot or other type of shoe when the device 10 is used a stomp pad. For example, as illustrated in FIGS. 4D and 9, relatively tall studs 30 can be located along an outer portion of the base 20, while shorter studs 32, 34 are located near closer to the interior. As a result, the strap 40 can be positioned over the shorter studs 32, 34 and other traction member having a lower profile (e.g., traction lines 36). Consequently, when a user places his or her boot over the entire device 10 (including the strap 40), the strap 40 can be advantageously pressed to a lower position (e.g., closer to the top surface of the base 20). In such arrangements, the strap 40 is less likely to interfere with a boot's ability to engage the studs or other protruding members of the device. For instance, this can help improve the traction between the bottom of the boot and the taller studs 30 positioned along a periphery of the base 20.

As discussed above, the strap 40 of the foot support device 10 is detachable from one or more of the loops 28 of the base 20. For example, the strap 40 can be completely removed in order to resurface a snowboard using an automatic grinding apparatus. In other arrangements, the strap can be removed and replaced if it has become worn or otherwise damaged, or if the user wishes to simply use a strap having a different color, design or general aesthetic look and feel.

Figure 10B:
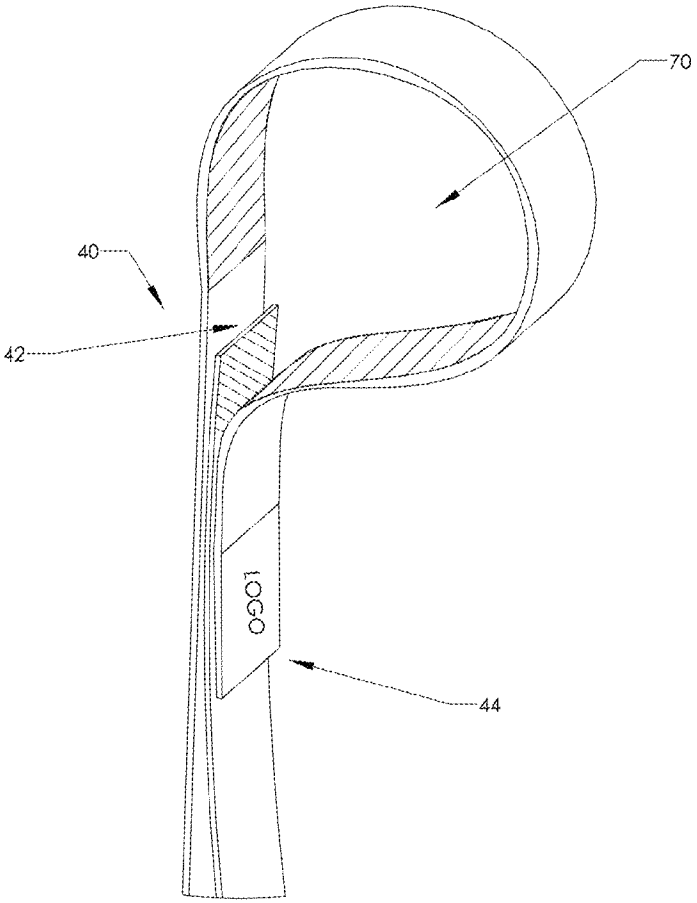
FIG. 10B illustrates a detailed perspective view of the device of FIG. 10A.
Figure 10A:
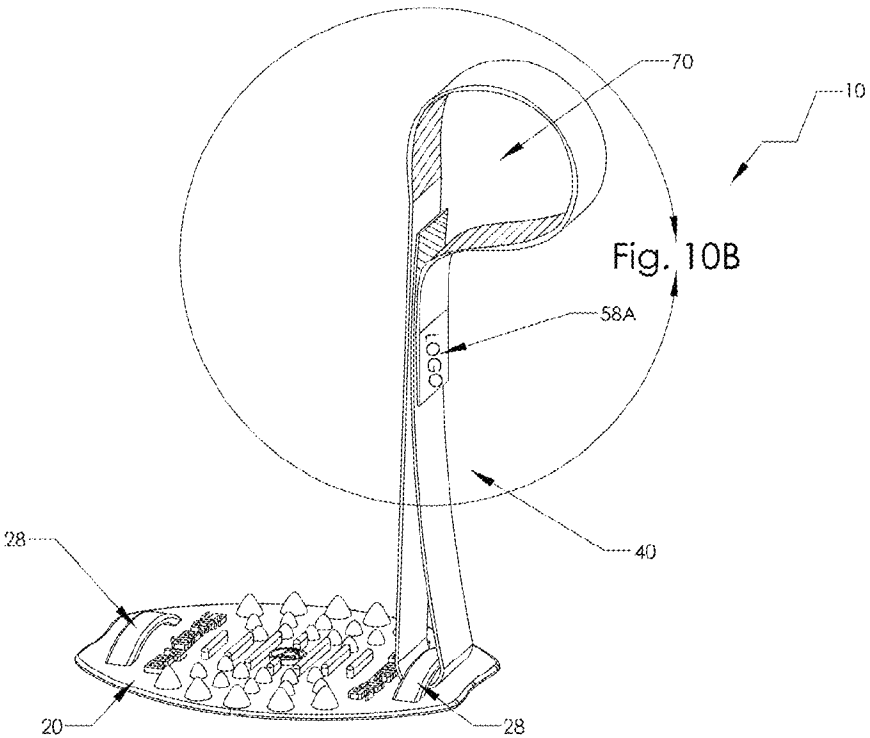
FIG. 10A illustrates a perspective view of a foot support device with a strap configured to be used as a wrist leash.
Figure 11A:
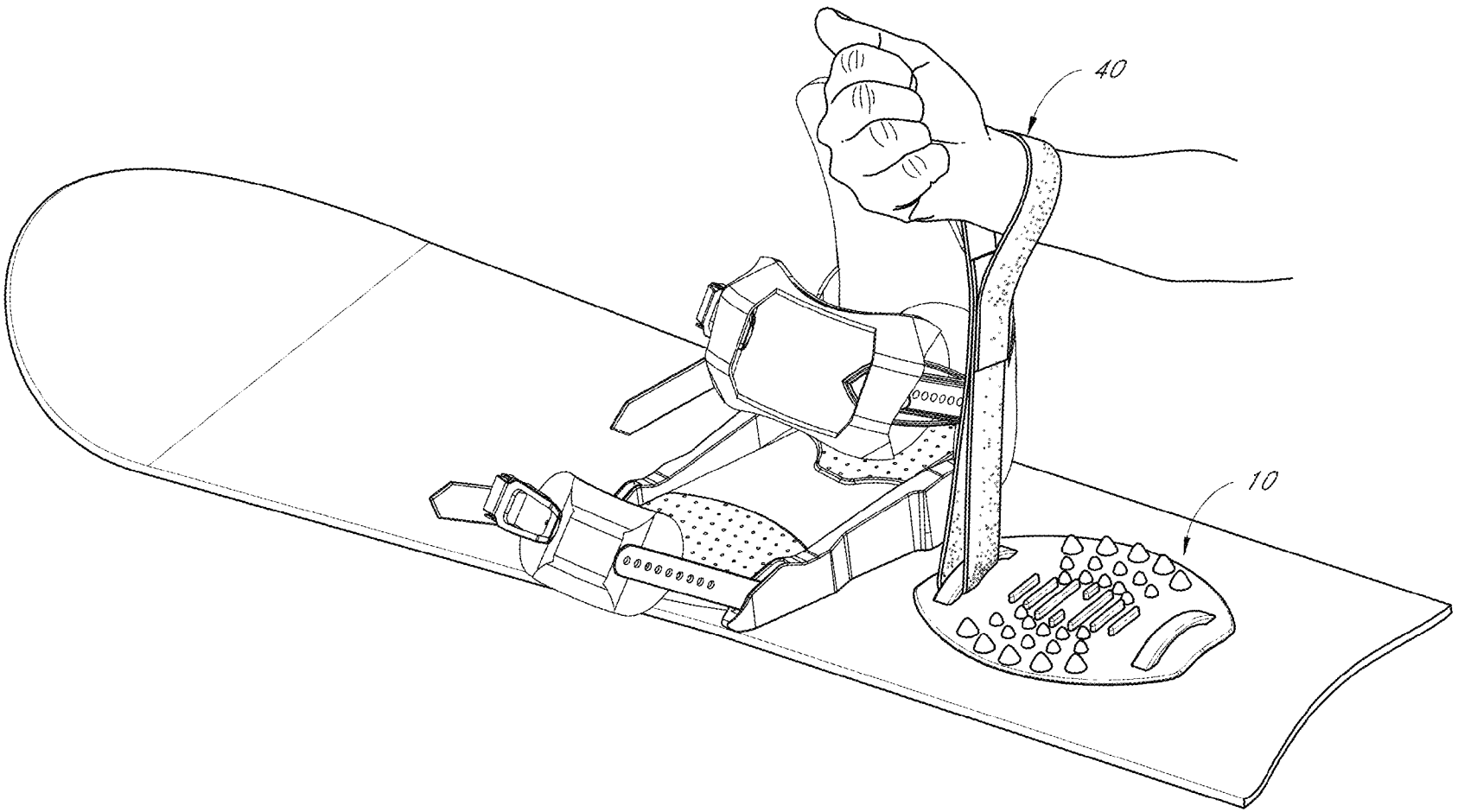
FIGS. 11A and 11B illustrates the foot support device of FIG. 10A attached to a snowboard.
Figure 11B:
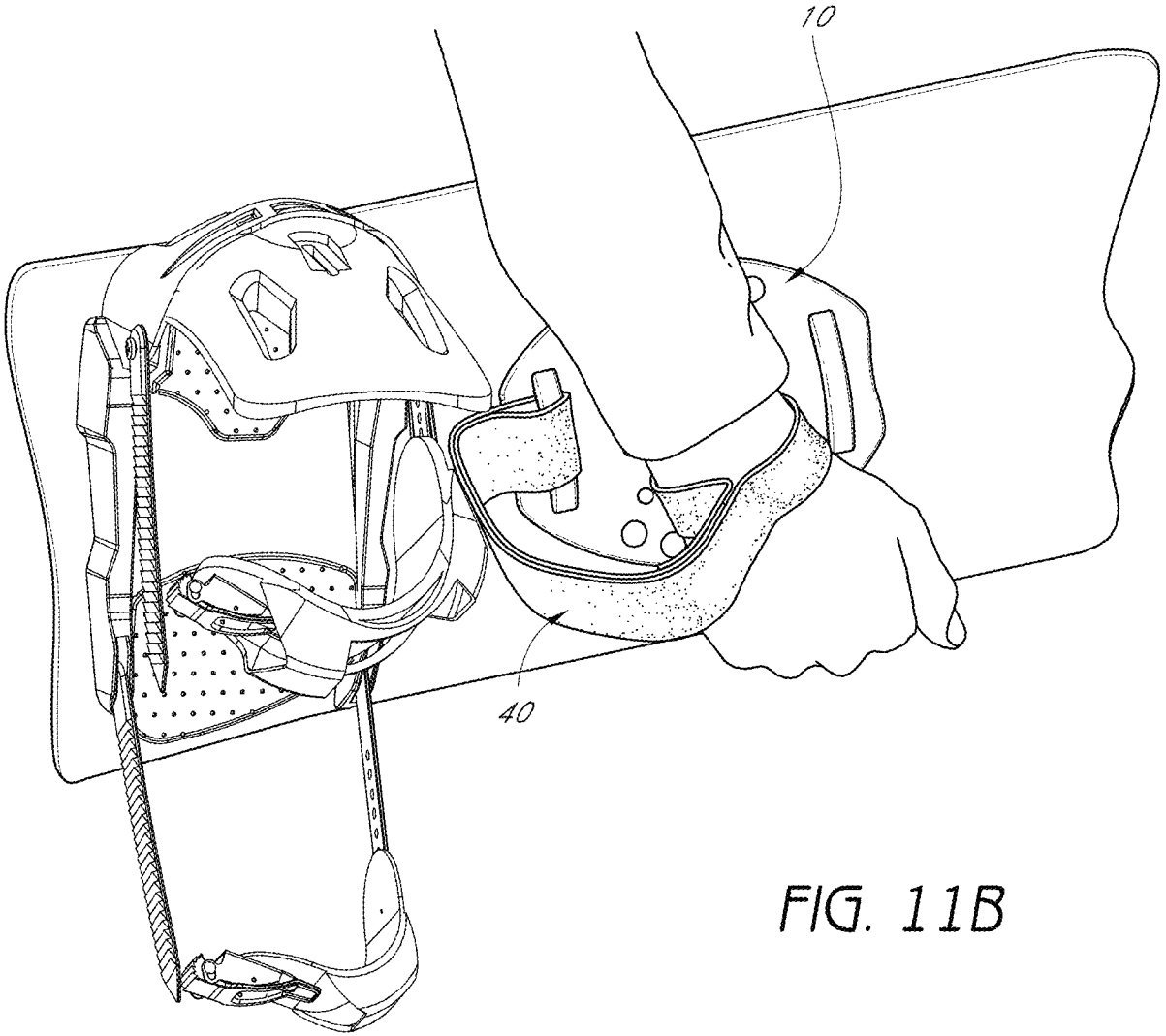

According to certain embodiments, as illustrated in FIGS. 10A-11B, the strap 40 can be removed from only one of the loops 28 and reconfigured to be used as a carrying or safety leash. Thus, the strap 40 can be used to help carry a snowboard. Alternatively, the strap can be used as a safety device to ensure that the snowboard does not injure someone and/or otherwise cause damage if it is inadvertently dropped by a user. Thus, as shown in FIG. 11B, the user can secure the loose end of the strap, in the form of a band 70, around his or her wrist, while the board is being carried.

The strap 40 can be conveniently reconfigured into the orientation illustrated in FIGS. 10A and 10B using the hook-and-loop fasteners or other connection features of the strap. In order to enhance the comfort and overall feel of the strap 40 while one of its loose ends is selectively arranged into a band 70 and secured to a user's wrist or other portion of his or her body, the strap can be configured to include one or more padding layers within an interior portion of the strap 40. Further, the strap surfaces that are configured to contact the user's skin (e.g., at or near the wrist band 70) can comprise the loop portion, as it generally offers a more comfortable feel when positioned against a person's skin.

Although these inventions have been disclosed in the context of a certain preferred embodiment and examples, it will be understood by those skilled in the art that the present inventions extend beyond the specifically disclosed embodiment to other alternative embodiments and/or uses of the inventions and obvious modifications and equivalents thereof. In addition, while several variations of the inventions have been shown and described in detail, other modifications, which are within the scope of this invention, will be readily apparent to those of skill in the art based upon this disclosure. It is also contemplated that various combinations or subcombinations of the specific features and aspects of the embodiments or variations can be made and still fall within the scope of the invention. It should be understood that various features and aspects of the disclosed embodiment can be combined with or substituted for one another in order to form varying modes of the disclosed invention. Thus, it is intended that the scope of the present inventions herein-disclosed should not be limited by the particular disclosed embodiments described above, but should be determined only by a fair reading of the claims that follow.

What is claimed is:

1. A foot support device configured for use on a snowboard, comprising:

a base having a bottom surface and an upper surface, said bottom surface configured to attach to a top of a snowboard;

a strap adapted for removable attachment to the upper surface of said base;

wherein the base comprises at least two loops, the strap being configured to be routed through at least one of said loops, wherein the strap is folded when the strap is secured to the at least two loops such that at least a portion of the strap comprises at least three layers;

wherein the strap defines a longitudinal axis that passes through the at least two loops when said strap is secured to the base;

wherein the base and the strap define an opening for at least partially receiving a boot therein;

wherein the base comprises a plurality of upwardly extending protruding members, said protruding members being configured to provide traction to a boot positioned thereagainst;

wherein the base is generally symmetrical about the longitudinal axis, thereby permitting the foot support device to be properly functional in either a regular or a goofy orientation;

wherein the device is configured: (i) to allow a user to place a boot through the opening to at least temporarily secure the boot to the snowboard, and (ii) to allow a user to position a boot on the device, over the strap to contact the at least some of the protruding members of the base;

wherein positioning the boot over the strap and exerting a force on the base allows a user to maintain traction with the snowboard without having to place the boot through the opening defined by the strap; and wherein the at least a portion of the strap comprising at least three layers enhances the resiliency of the strap so that the strap assumes its original, raised orientation once a user removes the boot from the device.

2. The device of claim 1, wherein protruding members located near a periphery of the base are generally taller than protruding members positioned near a center of the base.

3. The device of claim 2, wherein the strap is generally located over the protruding members positioned near the center of the base so that a boot can engage the protruding members located near the periphery of the base when the device is used as a stomp pad.

4. The device of claim 1, wherein the base is configured to be attached to a snowboard using an adhesive.

5. The device of claim 4, wherein said adhesive is positioned along the bottom surface of the base, said adhesive being selectively exposable using a peel-away liner.

6. The device of claim 1, wherein the base comprises polyvinyl chloride (PVC).

7. The device of claim 1, wherein the strap comprises nylon.

8. The device of claim 1, wherein the strap comprises hook-and-loop fasteners for adjusting an effective length of said strap.

9. The device of claim 1, wherein the protruding members comprise a generally conical shape.

10. The device of claim 1, the base further comprises a plurality of traction lines located beneath the strap.

11. A support device for attachment to a snowboard, comprising:

a base having a bottom surface and an upper surface, said bottom surface configured to attach to a top of a snowboard;

said base having at least two loops along said upper surface;

a strap configured for attachment to the loops of the base, said strap defining a longitudinal axis through said base when said strap is attached to the at least two loops, wherein the strap is folded when the strap is secured to the at least two loops such that at least a portion of the strap comprises at least three layers;

wherein the base and the strap define an opening for at least partially receiving a boot therein;

wherein the base comprises a plurality of traction members, said traction members configured to engage a lower surface of a boot positioned thereagainst;

wherein a height of traction members located near a periphery of the base is generally greater than a height of traction members positioned near a center of the base; and wherein the base is generally symmetrical about the longitudinal axis, thereby permitting a boot to be positioned with said support device from either side of a snowboard;

wherein the device is configured: (i) to allow a user to place a boot through the opening to at least temporarily secure the boot to the snowboard, and (ii) to allow a user to position a boot on the device, over the strap to contact the at least some of the protruding members of the base;

wherein positioning the boot over the strap and exerting a force on the base allows a user to maintain traction with the snowboard without having to place the boot through the opening defined by the strap; and wherein the at least a portion of the strap comprising at least three layers enhances the resiliency of the strap so that the strap assumes its original, raised orientation once a user removes the boot from the device.

12. The device of claim 11, wherein the strap is selectively removable from the loops of the base.

13. The device of claim 11, wherein the base is configured to be attached to a snowboard using an adhesive.

14. The device of claim 11, wherein the base comprises polyvinyl chloride (PVC).

15. The device of claim 11, wherein the strap comprises nylon.

16. The device of claim 11, wherein the traction members comprise a generally conical shape.

17. The device of claim 11, the strap can be detached from one loop of the base and reconfigured to be secured to a user's wrist.

* * * * *